US009919406B2

(12) United States Patent
Ohishi et al.

(10) Patent No.: US 9,919,406 B2
(45) Date of Patent: Mar. 20, 2018

(54) ABRASIVE MATERIAL PRODUCT, ITS PRODUCTION METHOD AND USE METHOD

(75) Inventors: Michihiro Ohishi, Sagamihara (JP); Yoko Togashi, Hachioji (JP); Yasuhiko Nagano, Kanagawa (JP)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 1719 days.

(21) Appl. No.: 12/995,479

(22) PCT Filed: Jul. 23, 2009

(86) PCT No.: PCT/US2009/051480
§ 371 (c)(1),
(2), (4) Date: Dec. 1, 2010

(87) PCT Pub. No.: WO2010/011801
PCT Pub. Date: Jan. 28, 2010

(65) Prior Publication Data

US 2011/0092137 A1 Apr. 21, 2011

(30) Foreign Application Priority Data

Jul. 24, 2008 (JP) ..... 2008-191232
Jul. 16, 2009 (JP) ..... 2009-167903

(51) Int. Cl.
*B24B 1/00* (2006.01)
*B24D 11/00* (2006.01)
*B24D 18/00* (2006.01)

(52) U.S. Cl.
CPC ..... *B24D 11/001* (2013.01); *B24D 18/0009* (2013.01)

(58) Field of Classification Search
CPC ..... B24D 11/001; B24B 1/00
USPC .... 451/28; 51/293, 297, 298, 307, 308, 309, 51/295
See application file for complete search history.

(56) References Cited

U.S. PATENT DOCUMENTS

| | | | | |
|---|---|---|---|---|
| 5,152,917 | A | 10/1992 | Pieper | |
| 5,378,252 | A | 1/1995 | Follensbee | |
| 5,733,178 | A * | 3/1998 | Ohishi | 451/41 |
| 6,848,986 | B2 * | 2/2005 | Kendall et al. | 451/526 |
| 2004/0031205 | A1 | 2/2004 | Ohishi | |

(Continued)

FOREIGN PATENT DOCUMENTS

| | | |
|---|---|---|
| JP | 62-255069 | 11/1987 |
| JP | 9-57632 | 3/1997 |
| JP | 9202040 | 8/1997 |

(Continued)

*Primary Examiner* — Robert Rose

(57) ABSTRACT

To provide an abrasive material with improved adhesion strength of an abrasive part to a substrate and durable to a severe abrasive work with applying high load and a long time abrading work. The abrasive material product comprises a substrate and an abrasive part having a plurality of shaped structures projecting from the substrate and is characterized in that the abrasive part comprises (1) an upper layer composed of a cured material of a mixture containing abrasive particles dispersed in a resin and (2) a lower layer composed of a cured material of a binder agent containing a radiation-curable monomer and/or oligomer and a thermosetting resin.

14 Claims, 6 Drawing Sheets

(56) References Cited

U.S. PATENT DOCUMENTS

| | | | | |
|---|---|---|---|---|
| 2005/0026229 | A1 | 2/2005 | Reiter | |
| 2011/0065362 | A1* | 3/2011 | Woo et al. | 451/28 |

FOREIGN PATENT DOCUMENTS

| | | | |
|---|---|---|---|
| JP | 9-225510 | | 9/1997 |
| JP | 2001-179640 | A | 7/2001 |
| JP | 2001-179913 | | 7/2001 |
| JP | 2005-319528 | A | 11/2005 |
| WO | WO 1999/007517 | | 2/1999 |
| WO | WO 2003/057410 | | 7/2003 |
| WO | WO 2005/026229 | | 3/2005 |
| WO | WO 2005/095060 | | 10/2005 |

* cited by examiner

ABRASIVE MATERIAL PRODUCT, ITS PRODUCTION METHOD AND USE METHOD

CROSS REFERENCE TO RELATED APPLICATIONS

This application is a national stage filing under 35 U.S.C. 371 of PCT/US2009/051480 filed 23 Jul. 2009, which claims priority to Japanese Patent Application No. 2008-191232, filed 24 Jul. 2008 and to Japanese Patent Application No. 2009-167903, filed 16 Jul. 2009, the disclosures of which are herein incorporated by reference in their entirety.

TECHNICAL FIELD

The present disclosure relates to an abrasive material product and particularly a coated abrasive material having durability to abrasive work with applying high load, and to its production method and use method.

BACKGROUND ART

It has been performed that a plurality of convex parts are shaped in an abrasive part of an abrasive material product and that the shapes are formed almost constant. The microstructure of the abrading face is made regular, so that local formation of deep scratches can be prevented and occurrence of loading (loading) can also be suppressed.

Patent Document 1 discloses an abrasive tape having an abrasive layer in one face of a substrate for an abrasive tape, wherein the tape comprises honeycomb form parts corresponding to defining lines and formed with a large number of approximately regular hexagons approximately evenly arranged back and forth and right and left on the entire surface of a coating layer to be the abrasive layer and recessed parts corresponding to the centers of the approximately regular hexagons. The recessed parts work for accumulating the abrasion powder at the time of abrading.

Patent Document 2 discloses an abrading method of a rolling roll for cold rolling of stainless steel by using lapping films with finer roughness as it goes closer to the final abrading process in abrading process comprising a plurality of steps with the lapping films with different roughness to shorten the abrading time.

Patent Document 3 discloses an abrasive material having a substrate and an abrasive layer formed on the substrate, wherein the abrasive layer has a three dimensional structure composed of shaped structures with a predetermined shape, in which a plurality of the shaped structures are regularly arranged. An applicable method disclosed in this document relates to a disk for optical abrading.

Patent Document 4 discloses an abrasive material having a substrate and an abrasive layer formed on the substrate, wherein the abrasive layer has parallel rows of prism shape or prism-like trapezoid, and the rows of the projected structures form an angle of 10 to 80° to the longitudinal direction of the substrate. The actually applicable method disclosed in this document relates to abrading of a curved face of a work piece.

Patent document 5 describes a composition for abrasive materials which comprises a plurality of abrasive particles and a binder agent. The binder agent comprised in the composition for abrasive materials is a polymerizable material substantially consisting of an ethylenically unsaturated material having one or more terminal functional groups of the same type of reactive functionality, a photoinitiator, and a thermal initiator. The composition for abrasive materials is applied to a substrate, the binder agent is at least partially cured by activating the photoinitiator, and further cured by activating the thermal initiator to provide a three-dimensional fixed abrasive material.

Patent document 6 describes a binder composition for abrasive tapes which comprises (a) a solid epoxy resin having a softening point of 60° C. or more and (b) curing catalysts. The epoxy resin is a cresol-novolac epoxy resin, a bisphenol A epoxy resin and the like, and the curing catalysts are imidazole derivatives and the like. An abrasive tape in which abrasive particles are fixed to a film substrate with the binder composition shows good abrasive performance.

Patent document 7 describes an easy-adhesive polyester film prepared by forming an easy-adhesive layer which comprises an acrylic resin having hydroxyl groups on a surface of a polyester film. The polyester film has good adhesive ability to a functional layer using an aqueous resin, and is suitably employed as a substrate for an OHP film, a label, a film for plotter, a film for photograph, a film for photographic printing paper and the like.

Patent document 8 describes an ink jet recording sheet prepared by forming an easy-adhesive layer which comprises a resin having sulfonic acid groups or sulfonate groups and amino groups at side chains on a surface of a polyester film. The sheet is excellent in adhesiveness of a receptor layer which has received aqueous ink.

Patent Document 1 Japanese Patent Laid-Open Publication No. S62-255069

Patent Document 2 Japanese Patent Laid-Open Publication No. H9-225510

Patent Document 3 Japanese Patent Laid-Open Publication No. 2001-179640

Patent Document 4 Japanese Patent Laid-Open Publication No. 2005-319528

Patent Document 5 U.S. Pat. No. 6,848,986

Patent Document 6 Japanese Patent Laid-Open Publication No. 57632/1997

Patent Document 7 Japanese Patent Laid-Open Publication No. 2001-179913

Patent Document 8 Japanese Patent Laid-Open Publication No. 202040/1997

EXPLANATION OF NUMBERING

Figure 1:
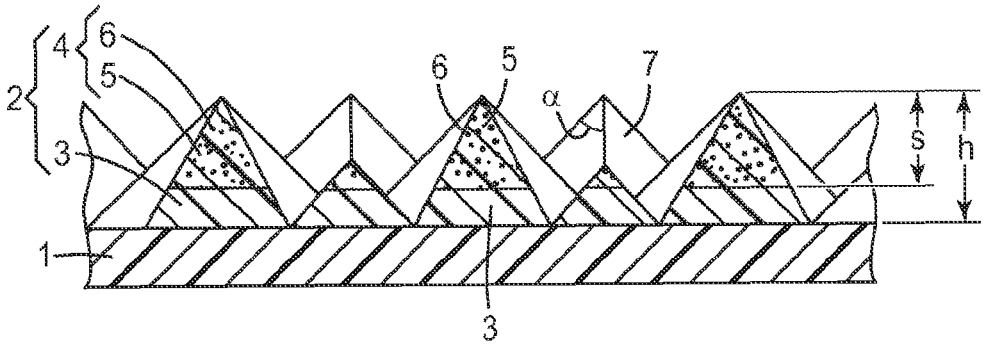
FIG. 1 A perspective sectional view of an abrasive material product having an abrasive part with triangular pyramid shaped structures.

1 . . . Substrate
2 . . . Abrasive part
3 . . . Lower layer
4 . . . Upper layer
5 . . . Resin
6 . . . Abrasive particles
7 . . . Shaped structures

DISCLOSURE OF THE INVENTION

When shaped structures projecting from the substrate are formed in an abrasive part of an abrasive material product, the microstructures of the abrasive face become regular, and loading is reduced in the abrasive part and both excellent fishing property and loading resistance for a long duration can be satisfied simultaneously. However, in the case of abrasive material products used for abrasive work with applying high load, no efficient means to improve the durability of the abrasive part itself has been discussed so far.

Therefore, the present disclosure provides an abrasive material product comprising an abrasive part excellent in the durability and durable for even a severe abrasive work with applying high load and a long time abrading work.

The present disclosure provides an abrasive material product comprising a substrate and an abrasive part having a plurality of shaped structures projecting from the substrate, in which the abrasive part comprises (1) an upper layer composed of a cured material of a mixture containing abrasive particles dispersed in a resin and (2) a lower layer composed of a cured material of a binder agent containing a radiation-curable monomer and/or oligomer and a thermosetting resin.

It is preferable that the above-mentioned abrasive material product is produced by a method comprising the steps of:

(1) filling a casting sheet having a plurality of recessed parts with an abrasive material coating solution containing abrasive particles, a resin, and a solvent to a predetermined depth;

(2) removing the solvent from the abrasive material coating solution filled in the recessed parts by evaporation;

(3) further filling the recessed parts with a binder agent coating solution containing a radiation-curable monomer and/or oligomer and a thermosetting resin;

(4) layering a substrate to the casting sheet to bond the binder agent to the substrate;

(5) making the binder agent non-flowable by radiating radioactive ray; and (6) curing the thermosetting resin.

In one embodiment, a curved face of a work piece is abraded by a method comprising the steps of:

bringing the above-mentioned abrasive material product into contact with the curved face of a work piece; and moving the work piece relatively to the abrasive material product to at least partially abrade the curved face.

The abrasive material product of the present disclosure has sufficiently high adhesive force between the abrasive part and the substrate since the resin composing the lower layer (substrate side) of the abrasive part contains a thermosetting resin and the abrasive part is hardly separated even if it is used for a severe abrasive work with applying high load. As a result, it is achieved an abrasive material remarkably excellent in durability.

The present disclosure provides an abrasive material product comprising a substrate and an abrasive part having a plurality of shaped structures projecting from the substrate. The abrasive part is a part of an abrasive material product that is brought into contact with an object to be abraded to exhibit the abrading function. In the case where the substrate is a sheet form, the abrasive part is formed in a layer state as to cover at least one surface. The abrasive material product with such a configuration is generally called as a coated abrasive material. The abrasive part is composed of a cured material of a mixture containing abrasive particles dispersed in a resin.

FIG. 1 is a cross-sectional view of an abrasive material product of an embodiment of the present disclosure. The abrasive material product comprises a substrate 1 and an abrasive part 2. The abrasive part 2 is separated into an upper layer 4 for contact with the substance to be abraded and a lower layer 3 adjacent the substrate side and has a double layer structure. The upper layer 4 contains a resin 5 and abrasive particles 6 dispersed therein. Although the lower layer 3 contains a resin, it is no need to contain abrasive particles. However, the lower layer 3 may contain abrasive particles, a coloring agent, and a coupling agent to an extent that no adverse effect on the adhesion strength between the substrate and the upper layer is caused.

Preferable materials for the substrate 1 comprise polymer films, paper, cloths, metal films, Balkan fibers, nonwoven substrates, their combinations, and their processed products. The substrate is preferably a flexible material. Further, the substrate is preferable to be transparent to ultraviolet ray radiation for convenience in curing the resin in a production process.

Substantially, the substrate may be a polymer film such as a polyester film. It is because a polymer film has good smoothness and even thickness and accordingly high finishing precision can be obtained. The polymer film may be subjected to easy adhesion treatment for promoting adhesiveness to the substrate of the abrasive part.

It is preferred that a primer for use in easy-adhesion treatment of polymer film is excellent in heat resistance. It is because the abrasive part becomes further resistant to destruction when the primer is resistant to thermal softening since an abrasive material product is heated to high temperature with frictional heat as it is employed for abrasive work with applying high load.

A particularly preferred material as the substrate is a polyester film. It is because polyester is excellent in mechanical strength, heat resistance, water resistance and oil resistance. When a polyester film is employed, thickness thereof is 10 to 500 μm, preferably 30 to 200 μm, more preferably 50 to 150 μm. The polyester film thickness within the range provides the flexibility which achieves good contact to an object to be abraded, and the strength which withstand the abrasive work with applying high load.

In a preferred embodiment of the present invention where abrasive material products are industrially mass-produced, it is necessary the process in which the steps of shaping an abrasive part, adhering it to a sheet-form substrate, and winding up the resulting abrasive material product are continuously conducted, so the shaped structures have to be adhered to the substrate in a short period of time. In order to adhere the shaped structures to the substrate in a short period time, it is preferred that the binder which forms the lower layer 3 is at least partially cured through the radiation curing mechanism to adhere onto a surface of the substrate. It is because application of radiation energy is able to be conducted in a short period of time, and because curing rate of the radiation-curable resins is high. On the contrary, heat energy requires substantial time for application, and the thermosetting resins are low in curing rate, so they are not suitable for the adhering process in a short period of time.

In a preferred embodiment, a transparent polymer film is employed as the substrate, the binder which forms the lower layer 3 is brought into contact with one surface thereof, light is irradiated from the opposite side of the transparent polymer film to cure the binder, and the shaped structures are adhered to the substrate at the same time. The resulted sheet form abrasive material product is then wound up and stored.

Therefore, lower layer 3 is substantially formed from a radiation-curable liquid binder. The radiation-curable means the property that it at least partially cures by absorbing radiation energy, and it adheres to a surface of the substrate.

Although radiation-curable resins absorb radiation energy to readily become non-flowable at room temperature, adhesion to the substrate tends to become insufficient. On the other hand, thermosetting resins make tough cured resins having elevated crosslinking density when they are heated for a certain period of time, and adhesion to the substrate becomes high. So it is able to provide the binder which absorbs radiation energy to readily become non-flowable or cure at room temperature and which improves adhesiveness to the substrate by heating thereafter by mixing the radiation-curable resins and the thermosetting resins.

In a preferred embodiment, the lower layer 3 is therefore composed of a cured material of a binder agent containing a radiation-curable liquid-state monomer and/or oligomer and a thermosetting resin. It is because adhesiveness to the substrate of the binder is sufficiently improved, the abrasive part becomes resistant to separation, and durability of the abrasive material product is improved, by comparison with the case where a radiation-curable liquid state monomer and/or oligomer is solely employed.

The radiation-curable liquid-state monomer and/or oligomer may comprise, for example, those known as a photocurable acrylic compound to a person skilled in the art. In one embodiment, they may be selected from a group consisting of acrylated urethane, acrylated epoxy, aminoplast derivatives having an α,β-unsaturated carbonyl group, ethylenic unsaturated compounds, isocyanurate derivatives having at least one acrylate group, isocyanates having at least one acrylate group, and their mixtures.

A photocurable acrylic compound generally has (meth) acryloyl group in a molecule and has a molecular weight of 70 to 700 and 80 to 600 in one embodiment. Generally, acrylic acid esters and methacrylic acid esters may be used. Specific examples of the photocurable acrylic compound are as follows.

Examples of a monofunctional acrylic monomer comprise isobornyl acrylate, 2-hydroxyethyl (meth)acrylate, hydroxypropyl acrylate, 4-hydroxybutyl acrylate, ethylene oxide modified phenol acrylate, cyclohexyl acrylate, tetrahydrofurfuryl acrylate, benzyl acrylate, N,N-dimethylacrylamide, N,N-diethylacrylamide, acryloylmorpholine, N,N-dimethylaminopropylacrylamide, isopropylacrylamide, dimethylaminoethyl acrylate, 2-hydroxy-3-phenoxypropyl acrylate, dicyclopentanyl (meth)acrylate, benzyl (meth)acrylate, phenoxyethyl (meth)acrylate, benzyl tribromo(meth)acrylate, phenoxyethyl tribromo(meth)acrylate, biphenylethoxy (meth)acrylate, biphenylepoxy (meth)acrylate, naphthylethoxy (meth)acrylate, fluoreneepoxy (meth)acrylate, and the like.

Examples of a polyfunctional acrylic monomer comprise ethylene glycol di(meth)acrylate, diethylene glycol di(meth) acrylate, trimethylolpropane tri(meth)acrylate, ethylene oxide modified trimethylolpropane tri(meth)acrylate, propylene oxide modified trimethylolpropane tri(meth)acrylate, hexanediol di(meth)acrylate, neopentyl di(meth)acrylate, pentaerythritol tetraacrylate, pentaerythritol triacrylate, ditrimethylolpropane tetra(meth)acrylate, 2-methacryloyloxyethyl-2-hydroxypropyl acrylate, bisphenol A di(meth)acrylate, bisphenol A tetrabromodi(meth)acrylate, bisphenol A ethoxy-modified di(meth)acrylate, bisphenol A tetrabromoethoxy-modified di(meth)acrylate, bisphenol A-epoxy di(meth)acrylate, bisphenol A-epoxy ethoxy-modified di(meth)acrylate, bisphenol A-epoxy tetrabromodi(meth) acrylate, bisphenol A-epoxy tetrabromoethoxy-modified di(meth)acrylate, and the like. Further, acrylic monomer mixtures thereof may also be used.

A preferred embodiment of the photocurable acrylic compound used for lower layer 3 is a mixture of a monofunctional acrylic monomer and polyfunctional acrylic monomer. In order to quickly cure a liquid-state binder, a polyfunctional acrylic monomer is preferred to be used. The polyfunctional acrylic monomer is however high viscosity and poor in compatibility with the thermosetting resins. If the polyfunctional acrylic monomer is solely employed as the photocurable acrylic compound, it becomes difficult that a homogeneous binder is prepared by mixing with sufficient amount of the thermosetting resins, and strength of the cured product tends to decrease.

On the other hand, a monofunctional acrylic monomer is low in viscosity, and superior in compatibility with the thermosetting resins. So it becomes possible that viscosity of the binder decreases, compatibility with the thermosetting resin is improved to provide homogeneous binder, and that strength of the cured product improves when the monofunctional acrylic monomer is employed in combination with the polyfunctional acrylic monomer as the photocurable acrylic compound.

Particularly preferred examples of the monofunctional acrylic monomer include isobornyl acrylate, benzyl acrylate and the like. Particularly preferred examples of the polyfunctional acrylate include trifunctional acrylates such as trimethylol propane triacrylate, ethylene oxide modified trimethylol propane tri (meth)acrylate, propylene oxide modified trimethylol propane tri(meth)acrylate, and tetrafunctional acrylate such as pentaerythritol tetraacrylate.

Mixing ratio of the monofunctional acrylic monomer and the polyfunctional acrylic monomer is 5 to 500 parts by weight, preferably 10 to 200 parts by weight, more preferably 20 to 100 parts by weight of the polyfunctional acrylate based on 100 parts by weight of the monofunctional acrylate. The weight ratio within the range makes it possible to adjust viscosity of a mixture solution with the thermosetting resin or hardness of a cured product within the desirable range.

The binder agent of the lower layer 3 may contain a photo polymerization initiator to efficiently carry out polymerization of the photocurable acrylic compound by light radiation. The type and the use amount of the photo polymerization initiator are changed in accordance with the type and the amount of the acrylic monomer, and their determination methods are known well to a person skilled in the art.

Specific examples of the photo polymerization initiator may comprise, as a radical polymerization initiator, benzophenone, 2-methyl-1-[4-(methylthio)phenyl]-2-morpholinopropan-1-one, camphor quinone, benzoin, benzoin methyl ether, benzoin n-propyl ether, benzoin n-butyl ether, benzil, p-methylbenzophenone, diacetyl, eosin, thionine, Michler's ketone, acetophenone, 2-chlorothioxanethone, anthraquinone, chloroanthraquinone, 2-methylanthraquinone, α-hydroxyisobutylphenone, p-isopropyl-α-hydroxyisobutylphenone, α,α'-dichloro-4-phenoxyacetophenone, 1-hydroxy-1-cyclohexylacetophenone, 2,2-dimethoxy-2-phenylacetophenone, methylbenzoin formate, dichlorothioxanthone, diisopropyl thioxanthone, phenyldisulfide-2-nitrosofluorene, butyroin, anisoin ethyl ether, tetramethylthiuram disulfide, 2,2-dimethoxy-1,2-diphenyl ethan-1-one, 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, 2-methyl-1-(4-methylthiophenyl)-2-morpholinopropan-1-one, 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone, 2,4,6-trimethylbenzoyl-diphenyl-phosphine oxide, bis(2,4,6-trimethylbenzoyl)-phenylphosphine oxide and the like.

The photo polymerization initiator is contained in an amount of 0.1 to 20 parts by weight and in one embodiment, 0.5 to 10 parts by weight based on 100 parts by weight of a radiation-curable liquid-state monomer and/or oligomer and a thermosetting resin. If the amount of the photo polymerization initiator is less than 0.1 part by weight, the acrylic monomer polymerization becomes difficult even if light is radiated, and if it exceeds 20 parts by weight, polymerization occurs even by weak light and the storage stability of the binder agent is deteriorated.

As described above, as a component of lower layer 3, a thermosetting resin may be employed with the radiation-curable liquid-state monomer and/or oligomer. The thermosetting resin may have functional groups which are of different type from those of the radiation-curable liquid-state monomer and/or oligomer. The thermosetting resin does not have to be radiation-curable. The thermosetting resin comprises those which are known as a thermosetting epoxy resin to a person skilled in the art. The thermosetting epoxy resin has two or more epoxy groups per one molecule, a molecular weight of 100 to 2,000, or 200 to 1,500, and epoxy equivalent weight of 50 to 1,000 or 100 to 750. Specific examples of the thermosetting epoxy resin are as follows.

Examples thereof comprise bisphenol A diglycidyl ether, bisphenol F diglycidyl ether, bisphenol S diglycidyl ether, tetrabromobisphenol A diglycidyl ether, resorcinol diglycidyl ether, phthalic acid diglycidyl ester, cresol novolac polyglycidyl ether, phenol novolac polyglycidyl ether, fluorene glycidyl ether, butanediol diglycidyl ether, hexanediol diglycidyl ether, cyclohexanediol diglycidyl ether, trimethylolpropane triglycidyl ether, glycerin polyglycidyl ether, ethylene-polyethylene glycol diglycidyl ether, sorbitol polyglycidyl ether, and the like. Mixtures thereof can be also used.

Particularly preferred thermosetting epoxy resins as a component of lower layer 3 comprise a cresol-novolac epoxy resin, a bisphenol A epoxy resin, or a mixture thereof. The cresol-novolac epoxy resin is particularly hard, and preferred when heat resistance is necessary. The bisphenol A epoxy resin is liquid, is easily miscible with the acrylic monomer and/or oligomer, and is preferred when flexibility is relatively necessary. By mixing the both in an appropriate ratio, hardness can be adjusted in between. The both are excellent in adhesiveness to the substrate and strength, and also good in compatibility with the acrylic monomer and/or oligomer.

In one embodiment of abrasive material product of the present disclosure, the epoxy resin comprises a cresol-novolac epoxy resin, a bisphenol A epoxy resin, or a mixture thereof, and the acrylic compound comprises a polyfunctional acrylate.

The binder agent of the lower layer 3 may contain a curing agent for curing the thermosetting epoxy resin. The type and the use amount of the curing agent are changed in accordance with a type and an amount of the thermosetting epoxy resin and their determination methods are known well to a person skilled in the art.

In one embodiment, the curing agent contain two or more functional groups thermally reactive on epoxy groups per one molecule and has a molecular weight of 100 to 2,000, in another embodiment, 200 to 1,500. Examples of the functional groups thermally reactive on epoxy groups may comprise amino groups, amido groups, mercapto groups, and the like. As the curing agent, generally, amines, amides, acid anhydrides, phenols, mercaptan compounds, tertiary amines, Lewis acid complexes, and the like are employed.

Specific examples of the curing agent comprise aliphatic amines having 4 to 20 carbon atoms such as hexamethylene diamine and diethylenetriamine; aromatic amines having 6 to 20 carbon atoms such as methaphenylenediamine, diaminophenylmethane, and diaminodiphenylsulfone; dicyanoamide and its derivatives having 2 to 20 carbon atoms; organic acid hydrazides having 3 to 30 carbon atoms such as phenylbiguanide and phenylbiguanide oxalate; $BF_3$ complexes having 2 to 10 carbon atoms such as a $BF_3$-monoethylamine complex and a $BF_3$-diethylamine complex; imidazole derivatives having 4 to 30 carbon atoms such as 2-methylimidazole, 2-ethyl-4-methylimidazole and 2-phenylimidazole; diaminomaleonitrile and its derivatives having 4 to 20 carbon atoms; melamine resin and its derivatives; acid anhydrides having 8 to 40 carbon atoms such as phthalic anhydride and pyromellitic anhydride; bismaleimide; and the like.

The curing agent can be an amine derivative having a molecular weight of 80 to 200, dicyanodiamide, and its derivatives.

The curing agent is used, for example, in the case of an imidazole derivative, in an amount of 0.5 to 20 parts by weight, in one embodiment, 1 to 10 parts by weight based on 100 parts by weight of a radiation-curable liquid-state monomer and/or oligomer and a thermosetting resin. If the amount of the curing agent is less than 0.5 part by weight, the thermosetting epoxy resin becomes difficult to be cured and the strength of the abrasive part is decreased, and if it exceeds 20 parts by weight, the hardness of the cured epoxy resin is decreased.

As the binder agent of the lower layer 3, a photocurable acrylic compound is preferably contained in an amount of 30 to 1,000 parts by weight, in one embodiment, 50 to 500 parts by weight based on 100 parts by weight of a thermosetting resin. If the amount of the photocurable acrylic compound is less than 30 parts by weight, it becomes difficult to nonfluidize the abrasive part 3 in the production process and if it exceeds 1,000 parts by weight, strength of the abrasive part 3 may decrease.

In one embodiment of abrasive material product of the present disclosure, the radiation-curable monomer and/or oligomer in the lower layer is an acrylic compound, the thermosetting resin is an epoxy resin, and 50 to 500 parts by weight of the acrylic compound is contained based on 100 parts by weight of the epoxy resin.

Particularly, when a mixture of the monofunctional acrylic monomer and the trifunctional acrylic monomer is employed as the photocurable acrylic compound for lower layer 3, and the bisphenol A diglycidyl ether and/or the cresol-novolac polyglycidyl ether are employed as the thermosetting acrylic compound, it is preferred that amount of the photocurable acrylic compound is adjusted to 100 to 200 parts by weight, particularly 120 to 180 parts by weight based on 100 parts by weight of the thermosetting resin to improve adhesiveness to a surface of the substrate.

In one embodiment of abrasive material product of the present disclosure, the acrylic compound is a mixture of a monofunctional acrylate and a polyfunctional acrylate.

Further, in one embodiment of abrasive material product of the present disclosure, the mixture comprises 20 to 100 parts by weight of the polyfunctional acrylate based on 100 parts by weight of the monofunctional acrylate.

The upper layer 4 is composed of a cured material of a mixture containing abrasive particles 6 dispersed in a resin 5. That is, the upper layer 4 is formed by solidifying a slurry containing a plurality of abrasive particles dispersed in the resin in uncured or ungelled state.

The size of the abrasive particles is, for final finishing abrading, 0.01 to 1 μm, in one embodiment 0.01 to 0.5 μm, and in another embodiment 0.01 to 0.1 μm; for rough abrading, 0.5 to 20 μm and in one embodiment 0.5 to 10 μm. The size of the abrasive particles may be 0.5 to 100 μm when lapping of brittle materials are conducted.

Examples of abrasive particles to be used for the present disclosure may comprise diamond, cubic boron nitride, cerium oxide, fused aluminum oxide, thermally treated aluminum oxide, sol-gel aluminum oxide, silicon carbide, chromium oxide, silica, zirconia, alumina-zirconia, iron oxide, garnet, and their mixtures. Particularly preferable examples are, for rough abrading, diamond, cubic boron nitride, aluminum oxide, and silicon carbide; for finishing abrading, silica and aluminum oxide.

When the abrasive material product is employed for abrasive work with applying high load, high toughness is required for abrasive particles. So preferred abrasive particles are the particles of fused aluminum oxide or diamond, particularly diamond particles.

The resin is cured or gelled to form the abrasive part. In one embodiment, examples of the resin may comprise phenol resins, aminoplast resins, urethane resins, epoxy resins, acrylic resins, polyester resins, vinyl resins, melamine resins, acrylated isocyanurate resins, urea-formaldehyde resins, isocyanurate resins, acrylated urethane resins, acrylated epoxy resins and their mixtures. Particularly preferable one is resol-phenol resins.

In one embodiment of abrasive material product of the present disclosure, the resin of the upper layer comprises a phenol resin.

The resin in the upper layer may be radiation-curable. The resin may be resins which are at least partially cured by radiation or at least partially polymerizable. In one embodiment, the radiation-curable liquid-state monomer and/or oligomer of the lower layer 3 is used. Based on the type of the resin to be used, energy sources such as infrared ray, electron beam, ultraviolet radiation, and visible light radiation may be used.

The weight ratio of the abrasive particles to the resin is generally in the range of about 150 to 1000 parts of the abrasive particles based on 100 parts of the resin and in one embodiment in the range of about 200 to 700 parts of the abrasive particles based on 100 parts of the resin. The ratio is changed depending on the size of the abrasive particles and the type of the resin and use of the abrasive material product.

In the case a hard material such as a crank shaft and a cam shaft of an engine is smoothly and precisely abraded, a preferable range of the weight ratio of the abrasive particles contained in the mixture to the resin is as follows. In the case where the abrasive particles are silicon carbide, it is about 75 to 900 parts based on 100 parts of the resin; in the case of spherical abrasive particles of alumina-silica, about 233 to 900 parts; in the case of alumina, about 59 to 900 parts; and in the case of diamond, about 64 to 900 parts.

The mixture composing the upper layer may contain materials other than the abrasive particles and the resin. For example, conventional additives such as a coupling agent, a moistening agent, a dye, a pigment, a plasticizer, a filler, a release agent, an abrasion assisting agent, and mixtures of them.

The above-mentioned mixtures may contain a coupling agent. Addition of the coupling agent can remarkably decrease the coating viscosity of the slurry to be used for forming the abrasive part. Examples of the coupling agent preferable for the present disclosure comprise organic silanes, zirconia aluminate and titanate. An amount of the coupling agent is generally less than 5% by weight to the total weight of the abrasive part and in one embodiment, less than 1% by weight.

Hereinafter, the morphology of the shaped structures projecting from the substrate will be described. The shaped structures mean projections formed in a predetermined shape. The shape of the projections is no need to be specified if it is a shape artificially formed and has reproducibility. However, the shape is not a random shape formed by natural action. In one embodiment, a plurality of the shaped structures have substantially the same shape and their arrangement in a plane is regular.

In one embodiment of abrasive material product of the present disclosure, a plurality of the shaped structures are formed to have the same height from the surface of the substrate.

In one embodiment of abrasive material product of the present disclosure, the shaped structures have a shape having a narrower surface area of a cross section parallel to the substrate as the cross section is more apart from the substrate.

Figure 2:
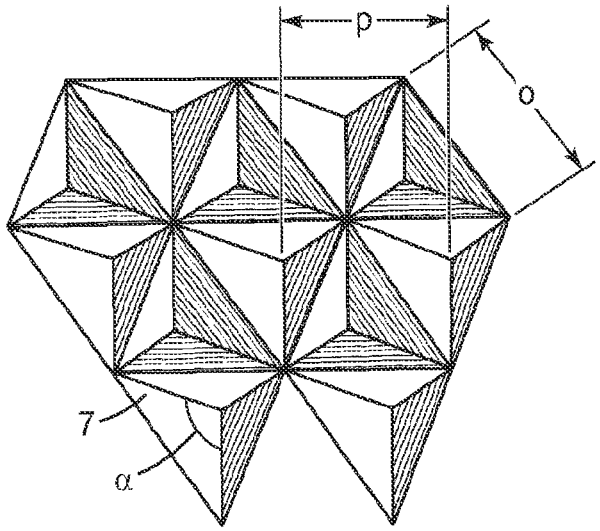
FIG. 2 A plan view of an abrasive material product having an abrasive part with triangular pyramid shaped structures.

In the embodiment shown in FIG. 1, the abrasive part 2 has a plurality of shaped structures 7 having substantially the same triangular pyramid shape, and their arrangement in a plane is regular as shown in FIG. 2.

The shaped structure 7 has a triangular pyramid shape having the ridges connected to the apex point. In this case, the apex angle $\alpha$ of a triangle which forms side surface of the triangular pyramid is generally in the range of 30 to 150° or in one embodiment, in the range of 45 to 140°.

The apexes of the shaped structures exist in a plane parallel to the substrate surface in almost all areas of the abrasive material product. In FIG. 1, the symbol h denotes height of the shaped structures from the substrate surface. In general, h is 2 to 300 μm and in one embodiment, 5 to 150

μm. Variation in height of the apexes is preferably within 20% of average height of the shaped structures and more preferably within 10%.

The abrasive particles are not projected beyond the surface of the shape of the shaped structures. That is, the shaped structures are composed of smooth surfaces. For example, the surfaces composing the shaped structures have surface roughness Ry of 2 μm or less and in one embodiment, 1 μm or less.

In the shaped structures, the apex parts exhibit abrading function. During the use of the abrasive material product for abrading, the shaped structures are decomposed from the apex parts and unused abrasive particles appear. Accordingly, it is preferable to increase concentration of the abrasive particles existing in the upper layer 4 of the shaped structures, in order to increase cutting property of the abrasive material product. It is because cutting property of the abrasive material product is improved and the abrasive material product becomes suitable for use in abrading hard materials. Concentration of the abrasive particles in the mixture existing in the upper layer 4 is preferably not less than the critical pigment volume concentration.

The critical pigment volume concentration is a volume concentration of particles in the case where the voids among particles are just filled with a binder agent when particles and the binder agent are mixed. This means the critical concentration that if it is lower than this concentration, the mixture has fluidity with the binder agent in liquid state, and if it is higher, fluidity is lost. In the case where concentration of the abrasive particles in the mixture existing in the upper layer 4 is equal to or lower than the critical pigment volume concentration, cutting property of the abrasive material product may become insufficient and thus unsuitable for abrading hard materials.

In FIG. 1, the symbol s denotes height of the upper layer of the shaped structures. The symbol s is in the range of 5 to 95% of height of the shaped structures and in one embodiment, in the range of 10 to 90%.

FIG. 2 is a plan view of the abrasive material product having the abrasive part with a triangular pyramid shape of the shaped structures. In FIG. 2, the symbol o shows bottom line length of the shaped structures. The symbol p shows distance between apexes of the shaped structures. The symbol o is, for example, in the range of 5 to 1000 μm and in one embodiment in the range of 10 to 500 μm. p is, for example, in the range of 5 to 1,000 μm and in one embodiment in the range of 10 to 500 μm.

Figure 3:
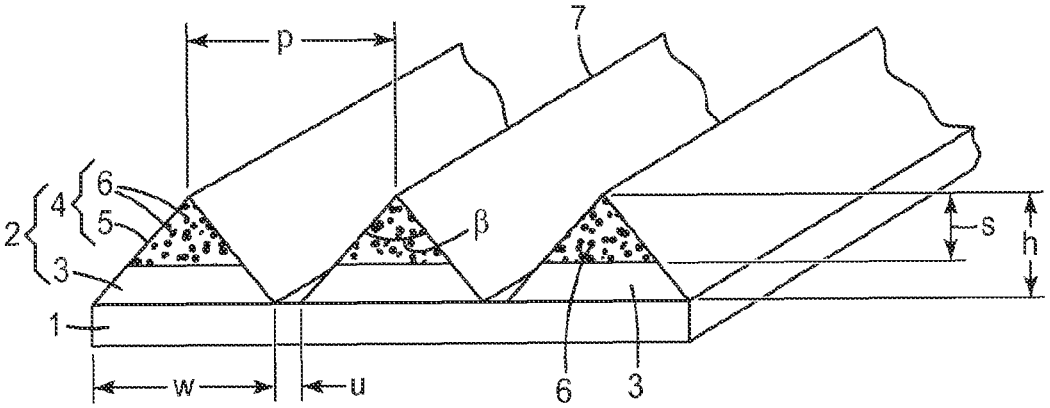
FIG. 3 A perspective sectional view of an abrasive material product having an abrasive part with prism shaped structures.

FIG. 3 is a perspective view of a cross section of the abrasive material product having the abrasive part with a prism shape of the shaped structures. The prism shape is a shape formed by setting triangle pole transversely. The configuration of this abrasive material product is the same as the abrasive material product shown in FIG. 1, except the shaped structures 7 of the abrasive part 2 is a prism shape.

The abrasive part 2 has rows of a plurality of the shaped structures 7 arranged in parallel. The apex angle β of the shaped structures is generally 30 to 150° and in one embodiment 45 to 140°. The cross sections of the shaped structures formed by cutting vertically to the longitudinal direction are not necessarily required to be an isosceles triangle. In the case where the cross sections of the shaped structures are not an isosceles triangle, the shaped structures have steep slopes and gentle slopes.

The ridges of the apexes of the shaped structures 7 exist in a plane parallel to the substrate surface in almost all region of the abrasive material product. Accordingly, contact of the abrasive particles to the object face to be abraded is made uniform and the finishing becomes extremely even and precise. The symbol h in FIG. 3 shows the height of the shaped structures from the substrate surface. The height, h, is generally 2 to 600 μm and in one embodiment, 4 to 300 μm. Variation in height of the apex lines is preferably within 20% of average height of the shaped structures and more preferably within 10%. The symbol s shows height of the shaped structures. s is, for example, 5 to 95% of the height h of the shaped structures and in one embodiment, 10 to 90%.

The shaped structures 7 are arranged in stripes. In FIG. 3, the symbol w shows length of the short bottom of the shaped structures (width of the shaped structures). The symbol p shows length same as the distance between apexes of the shaped structures, that is, the pitches of the shaped structures. The symbol u shows distance of long bottoms of the shaped structures. The length w is, for example, 2 to 2,000 μm and in one embodiment, 4 to 1,000 μm. The distance p is, for example, 2 to 4,000 μm and in one embodiment, 4 to 2,000 μm. The distance u is, for example, 0 to 2,000 μm and in one embodiment, 0 to 1,000 μm.

The length of the shaped structures 7 may be extended to almost the entire region of the abrasive material product. Alternatively, it may be broken in a proper length. The bottom faces of the shaped structures may have an aspect ratio of 2 or higher and in one embodiment, 5 or higher. The end parts may be arranged evenly or unevenly. It is also allowed that the end parts of the shaped structures with the prism shape are cut at an acute angle to form a hipped roof-like shape.

Figure 4:
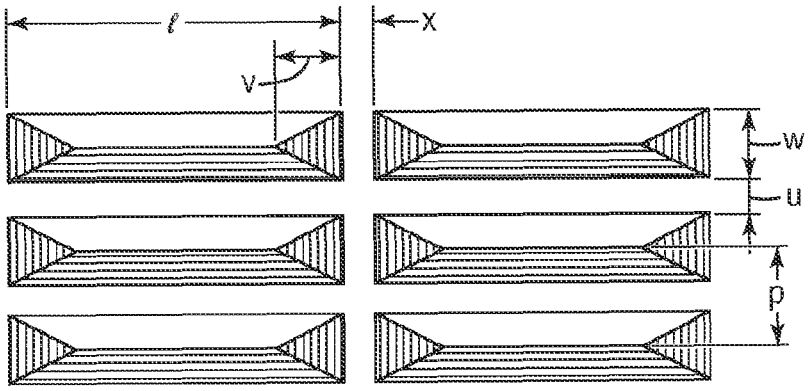
FIG. 4 A plan view of an abrasive material product having an abrasive part with hipped roof-like shaped structures.

FIG. 4 is a plan view of the abrasive material product having the shaped structures with a hipped roof-like shape of the abrasive part. In FIG. 4, the symbol 1 shows long bottom length of the shaped structures. The symbol v shows distance of the portions cut at an acute angle in the shaped structures. The symbol x shows distance of short bottoms of the shaped structures. The definitions of the symbols w, p, and u are same as those in FIG. 3. The length l is, for example, 5 to 10,000 μm and in one embodiment, 10 to 5,000 μm. The distance v is, for example, 0 to 2,000 μm and in one embodiment, 1 to 1,000 μm. The distance x is, for example, 0 to 2,000 μm and in one embodiment, 0 to 1,000 μm. The length w is, for example, 2 to 2,000 μm and in one embodiment, 4 to 1,000 μm. The distance p is, for example, 2 to 4,000 μm and in one embodiment, 4 to 2,000 μm. The distance u is, for example, 0 to 2,000 μm and in one embodiment, 0 to 1,000 μm.

In another embodiment, the shaped structures may be prism-like trapezoid formed by cutting apexes at a predetermined height. In that case, the apexes of the shaped structures are made to form planes in parallel to the substrate surface. It is referable that substantially all of the planes exist in a plane parallel to the substrate surface. Accordingly, contact of the abrasive particles to the object face to be abraded is made uniform and the finishing becomes extremely even and precise. Height of the shaped structures is 5 to 95% of the height before cutting the apexes and in one embodiment, 10 to 90%.

The abrading faces of the abrasive material product have the shaped structures with the prism shape, so that the abrading action is anisotropic and the abrading capability also differs in accordance with the direction of the movement of an object face to be abraded relative to the abrading face. In the case where the outer circumferential face of a cylindrical work piece, particularly a hard material of a cylindrical part for a crank shaft and a cam shaft of an engine, is smoothly and precisely abraded, it is preferable that the direction of movement of the object face to be abraded does not be vertical to the longitudinal direction of the shaped structures.

Figure 5:
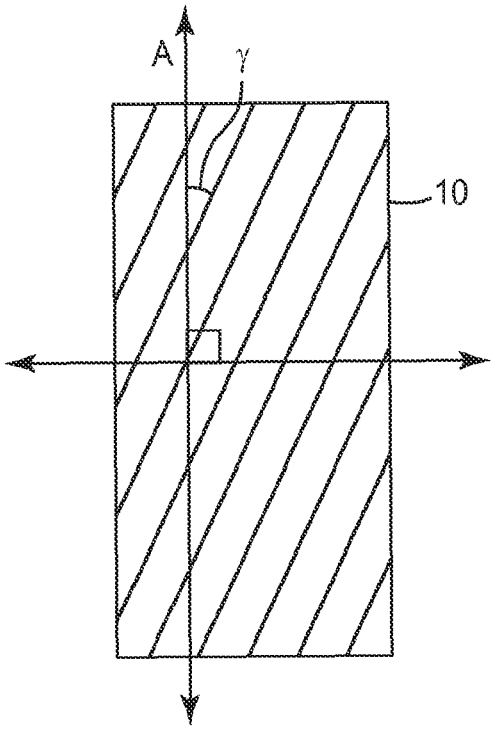
FIG. 5 A plan view schematically showing an example of arrangement of shaped structures preferable for an abrasive material product of the present disclosure.
Figure 6A:
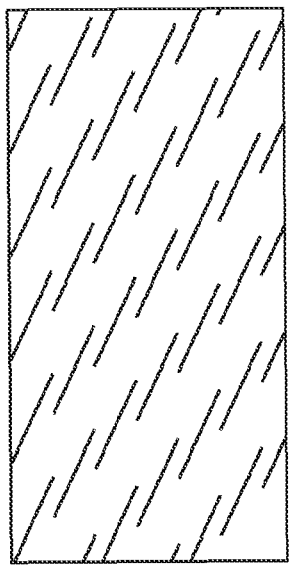
FIGS. 6*a-b* Plan views schematically showing an example of arrangement of shaped structures preferable for an abrasive material product of the present disclosure.
Figure 6B:
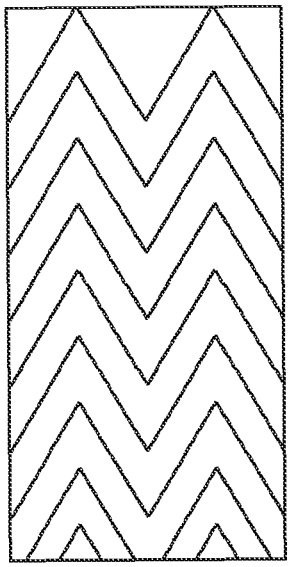

FIGS. 5 and 6*a-b* schematically show plan views of examples of the arrangement of preferable shaped structures for the abrasive material product disclosed here. The arrow A in FIG. 5 shows the direction in parallel to the direction of the movement of the object face to be abraded in a abrading step. This direction is called as the longitudinal direction of the abrasive material product. The direction vertical to the longitudinal direction is called as the transverse direction of the abrasive material product. In the case where a cylindrical work piece is abraded, the transverse direction becomes parallel to the axis of the work piece. The shaped structures 7 of the abrasive material product 10 are arranged in a manner that the longitudinal direction forms at an angle γ to the longitudinal direction of the abrasive material product.

The angle γ is adjusted properly in the range of 5 to 85°, in one embodiment, 15 to 80°, and in another embodiment, 30 to 70°. If γ is less than 5°, it becomes difficult to obtain fine finishing, and if it exceeds 85°, it becomes easy to cause loading.

An arrangement pattern of the shaped structures is not limited to a stripe-like pattern and, for example, it may be, as shown in FIG. 6*a*, reciprocal arrangement, and as shown in FIG. 6*b*, zigzag arrangement.

In one embodiment of abrasive material product of the present disclosure, the shaped structures form parallel rows of a prism shape or prism-like trapezoid and the rows of the shaped structures form an angle of 10 to 80° to the longitudinal direction of the substrate.

An example of particularly preferred embodiment of the present disclosure is an abrasive material product comprising a polyester film substrate of 20 to 200 μm in thickness and an abrasive part having a plurality of shaped structures projecting from the substrate, wherein the abrasive part comprises (1) an upper layer composed of a cured material of a mixture containing diamond abrasive particles dispersed in a phenol resin and (2) a lower layer composed of a cured material of a binder agent containing isobornyl acrylate and trimethylol propane triacrylate and a cresol-novolac epoxy resin, and wherein the shaped structures form parallel rows of a prism shape or prism-like trapezoid having a cross-sectional height of 20 to 200 μm, and a bottom length of 20 to 50 μm, and the rows of the shaped structures form an angle of 10 to 80° to the longitudinal direction of the substrate.

The abrasive material product of the present disclosure is preferable to be produced by the following method.

At first, an abrasive material coating solution containing abrasive particles, a resin, and a solvent is prepared. The abrasive material coating solution is a composition containing a binder agent, abrasive particles, and if necessary, additives such as a photoinitiator in respective amounts sufficient for composing a mixture and also a volatile solvent in an amount sufficient to provide the mixture with fluidity. Even if content of the abrasive particles in the mixture exceeds the critical pigment volume concentration, addition of the volatile solvent to the abrasive material coating solution makes it possible to keep fluidity.

Preferable volatile solvents are organic solvents dissolving the binder agent and showing volatile property in the range of room temperature to 170° C. Specific examples comprise methyl ethyl ketone, methyl isobutyl ketone, toluene, xylene, ethanol, isopropyl alcohol, ethyl acetate, butyl acetate, tetrahydrofuran, propylene glycol monomethyl ether, propylene glycol monomethyl ether acetate and the like. Further, another preferable solvent is water.

Then, a casting sheet having a plurality of recessed parts with a tapered shape in the bottom side and arranged regularly in a plurality of rows is prepared. The shape of the recessed parts may be a reverse shape of the shaped structures to be formed. Materials of the casting sheet may be metals such as nickel, plastics such as polypropylene, or the like. For example, since thermoplastic resins such as polypropylene can be embossed at their melting point on a metal tool, the recessed parts with a predetermined shape can be easily formed and therefore, they are preferable. Further, in the case where a binder agent is a radiation-curable resin, materials which can transmit ultraviolet rays and visible light rays are preferable to be used. FIGS. 7*a-e* are step-wise views schematically showing one example of a production method of an abrasive material product having an abrasive part with the shaped structures.

Figure 7A:
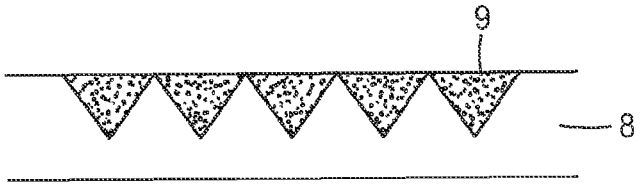
FIGS. 7*a-e* Step-wise views schematically showing one example of a production method of an abrasive material product having an abrasive part with the shaped structures.

As shown in FIG. 7*a*, the abrasive material coating solution 9 is filled in the obtained casing sheet 8. The filling amount is a sufficient amount to form the upper layer 4 by evaporating the solvent and curing the binder agent. Generally, the solution may be filled in an amount sufficient to give the size of s shown in FIG. 1 and FIG. 3 as the depth from the bottom after the solvent is evaporated.

The filling may be carried out by applying the abrasive material coating solution to the casting sheet by a coating apparatus such as a roll coater or the like. At the time of coating, the viscosity of the abrasive material coating solution is adjusted to be 10 to $10^6$ cps and preferably 100 to $10^5$ cps.

Figure 7B:
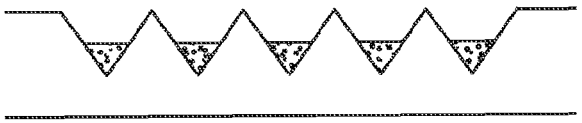

As shown in FIG. 7*b*, the solvent is removed from the filled abrasive material coating solution by evaporation. At that time, the casting sheet filled with the abrasive material coating solution is heated generally at 50 to 150° C. Heating is carried out for 0.2 to 10 minutes. In the case where the binder agent is a thermosetting resin, the heating may be carried out at a curing temperature to simultaneously carry out the curing step. In the case where the solvent has high volatility, it may be carried out by leaving it at room temperature for several minutes to several hours.

Figure 7C:
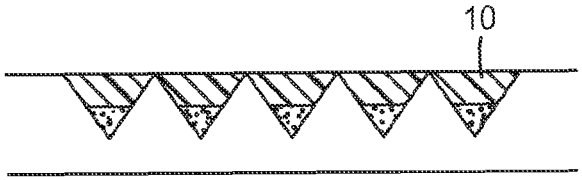

As shown in FIG. 7*c*, a binder coating solution 10 is further filled in the casting sheet to fill the recessed parts with a binder agent. A binder agent excellent in the adhesion property to the substrate is preferable.

The binder agent is composed of a cured material of a binder agent containing the above-mentioned radiation-curable liquid monomer and/or oligomer and a thermosetting resin. For example, a thermosetting epoxy resin is dissolved in a liquid-state photocurable acrylic compound and successively a photo polymerization initiator and a curing agent are mixed to the obtained solution to give a binder agent.

Figure 7D:
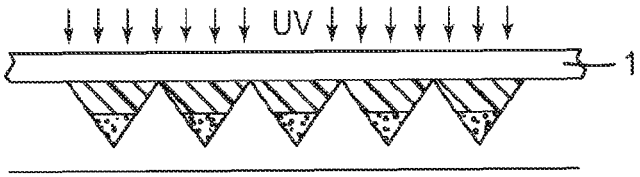

As shown in FIG. 7*d*, a substrate 1 is adhered to the casting sheet 8 and the binder agent is stuck to the substrate. The bonding is carried out by, for example, pressurizing with rolls or a method of lamination.

Next, the radiation-curable liquid-state monomer and/or oligomer contained in the binder agent is crosslinked by radiating energy. The degree of crosslinking is sufficient to make the entire body non-flowable and give hardness to an extent that leakage is not caused from the casting sheet even if it is rolled.

For the energy to be radiated, infrared rays, electron beam, ultraviolet rays, or visible light rays may properly be selected. The radiation intensity of the energy differs in accordance with the type of the binder agent and a radiation energy source. Generally, the intensity of the radiation energy can properly be determined by a person skilled in the art. A time taken to give non-fluidity is changed in accordance with the thickness, density, temperature of the binder agent, the characteristics of the composition, and the like.

For example, ultraviolet rays (UV) may be radiated from the upper side of the transparent substrate to make the binder non-flowable.

Thereafter, the obtained abrasive material product and the casting sheet are kept at 50 to 150° C. to carry out heating until the thermosetting resin contained in the abrasive part is cured. The heating may be carried out after the abrasive material product and the casting sheet are wound up to a roll form.

In one embodiment of production method of an abrasive material product according the disclosure, the step of curing thermosetting resin is carried out by a process comprising the steps of:

rolling the abrasive material product containing the binder agent made non-flowable by radiating radioactive ray and the casting sheet to a roll form; and keeping the rolled abrasive material product and casting sheet in the roll form at 50 to 150° C. to cure the abrasive part.

Figure 7E:
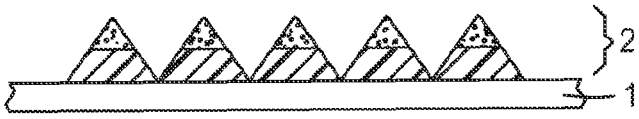

As shown in FIG. 7*e*, the casting sheet is removed to obtain the abrasive material product comprising the substrate 1 and the abrasive part 2 having the shaped structures. After the casting sheet is removed, the thermosetting resin may be cured.

In the production method of the abrasive material product of the present disclosure, since the resin composing the lower layer of the abrasive part contains the radiation-curable liquid-state monomer and/or oligomer, while the abrasive part is formed and at the same time made non-flowable continuously by radiating radiation beam. Therefore, a thermosetting process requiring time can be carried out separately from the forming process and collectively thereafter, and high productivity can be obtained very simply.

If the abrasive material product of the present disclosure is used, the outer circumferential face of a cylindrical work piece can be preferably abraded. For example, the above-mentioned abrasive material product is pushed to the outer circumferential face of the cylindrical work piece in a manner that the vertical direction of the product is perpendicular to the work piece and while a lubricant, a coolant, or a abrading liquid containing their combination, the cylindrical work piece is rotated, that is, the abrasive material product is gradually fed in the direction opposed to or same as the direction of movement of the object face to be abraded, further in other embodiments, oscillation in a transverse direction is carried out, while the abrading is carried out. Such an abrading method may be carried out generally using a super finishing apparatus or a micro-finisher apparatus.

Figure 8:
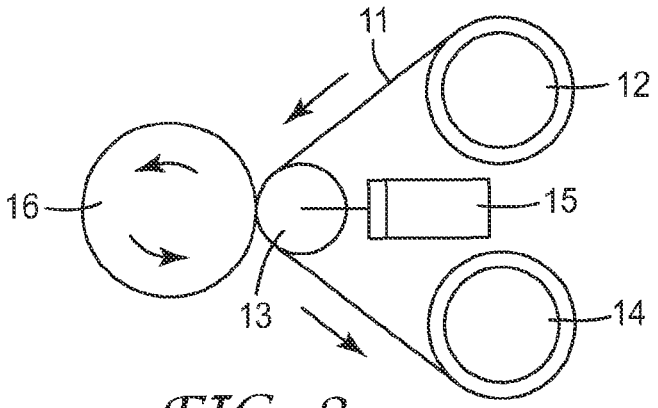
FIG. 8 A schematic view showing the configuration of a super finishing apparatus (manufactured by GEM).

FIG. 8 is a schematic view showing the configuration of a super finishing apparatus. An abrasive material product 11 is fed out of a feeding roll 12 and wound up on a rolling roll 14 via a contact roll 13. The contact roll is pushed to the outer circumferential face of the cylindrical work piece 16 by an air cylinder 15. While the cylindrical work piece 16 is rotated in the direction of the arrow, the abrasive material product is fed to the direction opposed to the direction of movement of the object face to be abraded to carry out abrading.

Figure 9:
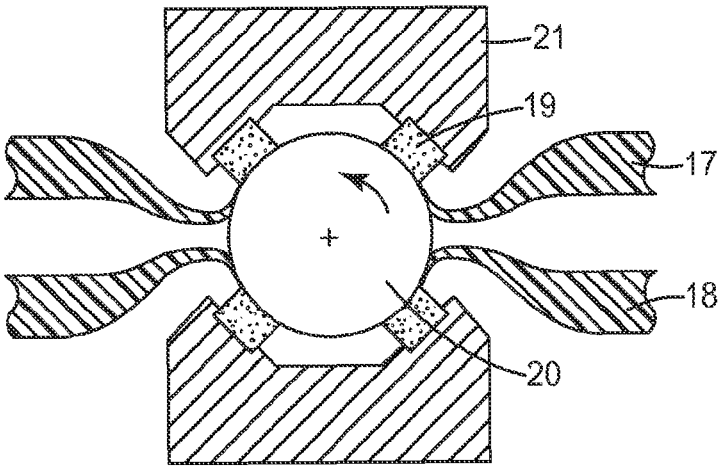
FIG. 9 A schematic view showing the configuration of a micro finisher apparatus (manufactured by Nachi-Fujikoshi Corporation).

FIG. 9 is a schematic view showing a configuration of a micro-finisher apparatus. Long abrasive material products 17 and 18 are closely attached and pushed to the outer circumferential face of a cylindrical work piece 20 by shoe 21 via stone 19. While the cylindrical work piece is rotated in the direction of the arrow, the abrasive material product is fed to the direction opposed to the direction of movement of the object face to be abraded to carry out abrading.

The abrasive material product of the present disclosure is excellent in heat resistance of interface where the abrasive part and the substrate are adhered, and the abrasive part is extremely resistant to separation from the substrate even if, for example, the abrasive material product is heated to high temperature with friction heat generated at abrading. So the abrasive material product of the present disclosure is particularly suitable for use in abrasive work with applying high load. The abrasive work with applying high load used herein means the abrading work which is carried out, under a certain level of load being applied to a surface to be abraded of an object to be abraded, the level of load being such that those skilled in the art regard as high load.

For example, when an outer circumferential face of a rod-like work piece having concaves and convexes at outer circumferential part such as a crankshaft and a camshaft is abraded by using the method for abrading an outer circumferential face of a cylindrical work piece as described above, abrasive pressure to the convex part becomes strong, and abrasive pressure to the concave part becomes weak, and the abrasion may result in uneven as the outer circumferential face is entirely evaluated. In order to minimize the variation in pressure, rotation speed of the rod-like work piece should become slower than the case of abrading the cylindrical work piece. The slow rotation speed makes abrasive efficiency poor, so in order to recover the abrasive efficiency, abrasive pressure should be configured to a high level.

That is, an example of the abrasive work with applying high load is the abrading work which is carried out under an abrasive condition which has a slower rotation speed and a higher abrasive pressure by comparison with the cases carried out with the cylindrical work piece. It is generally employed an apparatus which is the same as those employed for abrading an outer circumferential face of a cylindrical work piece for this use. Specific examples of the apparatus are shown in FIG. 8 and FIG. 9.

That is, in the abrasive work, the above described abrasive material product is pressed to contact with the outer circumferential face of the rod-like work piece having concaves and convexes at outer circumferential part so that the longitudinal direction of the abrasive material product becomes perpendicular to the axis, and the rod-like work piece is rotated to carry out abrasion, for example, in which the load applied to the rod-like work-piece through the abrasive material product is configured to 10 to 50 kg per 1 cm during abrasion to abrade the outer circumferential face of the work piece.

Figure 11:
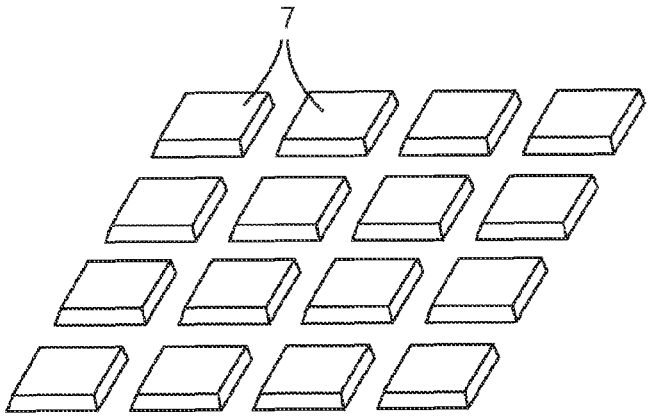
FIG. 11 A perspective view showing an abrasive material product which has shaped structures of tile form at the abrasive part.
Figure 12A:
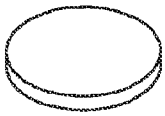
FIGS. 12*a-g* Perspective views showing examples of form which is able to be employed as the shaped structure for the abrasive material product as shown in FIG. 11.
Figure 12B:
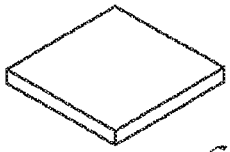
Figure 12C:
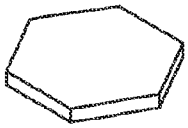
Figure 12D:
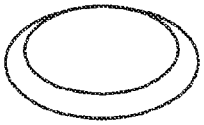
Figure 12E:
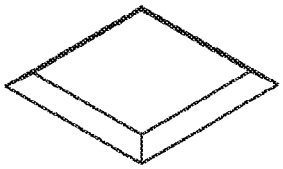
Figure 12F:
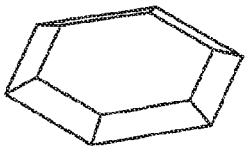
Figure 12G:
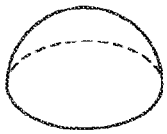

FIG. 11 is a perspective view showing an abrasive material product which has shaped structures of tile form at the abrasive part. The abrasive material product of this embodiment is suitable for use in lapping brittle materials. As the brittle materials to be abraded, glass, quartz, crystal, lithium niobate, sapphire, a ceramic hard disk, a photomask, a photonic device, an oscillator and the like are illustrated.

The abrasive part of the abrasive material product has a plurality of shaped structure 7 of square tile form which are substantially the same in form, and the planar arrangement thereof is regular. The size of shaped structure 7 is 20 to 20000 μm in one side of the bottom, 10 to 10000 μm in height. The distance between shaped structure 7 is 5 to 20000 μm in between the bottoms thereof.

FIGS. 12*a-g* are perspective views showing examples of form which is able to be employed as the shaped structure for the abrasive material product as shown in FIG. 11. Additionally, the forms such as multiangular prism, truncated multiangular pyramid, and oval hemisphere and the like may also be illustrated as the shaped structure.

The present disclosure will be described more specifically with reference to the following Examples; however, the disclosure should not be limited to them. The numeral values showing the amounts of components in Examples mean parts by weight unless otherwise specified.

EXAMPLES

Examples 1 to 3 and Comparative Example 1

Production of Abrasive Material Products

Components shown in Table 1 were mixed to prepare an abrasive coating solution. Pre-mixtures were prepared by dissolving an epoxy resin in the acrylic compound shown in Table 2. Components shown in Table 3 were mixed to prepare curing catalyst/initiator solutions. Next, the pre-mixtures and the curing catalyst/initiator solutions were mixed to prepare binder coating solutions.

TABLE 1

| Component | Weight (kg) | Solid content (%) |
|---|---|---|
| Aluminum oxide particles ("WA #2000", made by Nanko Abrasives Industry Co., Ltd.) | 100.0 | 100 |
| Resol phenol resin (60% non-volatile content, 20% water, and residueal organic solvent) | 58.3 | 60 |
| Propylene glycol monomethyl ether | 45.0 | 0 |
| Total | 203.3 | 66.4 |

A casting sheet made of polypropylene and having recessed parts with a shape reverse to a prism trapezoid shape of the shaped structures with having steep slopes and gentle slopes was prepared. Next, each abrasive material coating solution was applied to the casting sheet by a knife coater and dried at 50° C. for 5 minutes.

Each of the binder coating solutions was applied thereon and HPE polyester film of 75 μm in thickness treated with easy adhesion, manufactured by Teijin-DuPont Films Japan Limited, was overlapped and laminated by pressure application by rolls. While the ultraviolet ray was radiated from the polyester film side to make the binder non-flowable, the laminate product was wound up to a roll form.

The rolled laminate product was put in an oven and heated at 90° C. for 20 hours to cure the resin of the abrasive material coating solution. After the laminate product was cooled to room temperature, the casting sheet was separated from the laminate product to obtain an abrasive film. The obtained abrasive film was further put in an oven and heated at 110° C. for 24 hours to cure the resin.

Figure 10:
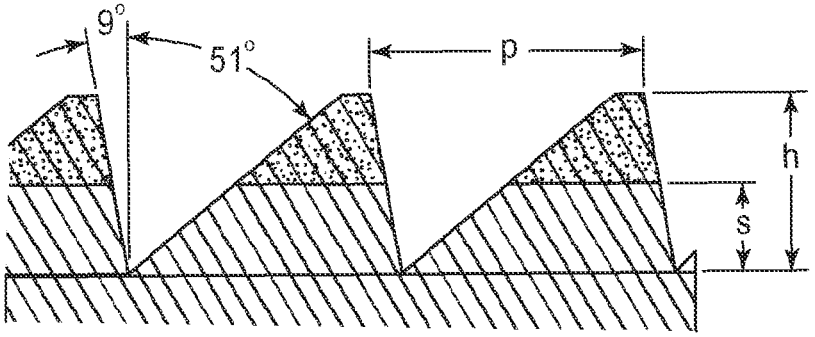
FIG. 10 A cross-sectional view of an abrasive part of Example cut vertically to the longitudinal direction of the shaped structures.

The abrasive film had an abrasive part having prism trapezoidal shaped structures arranged in stripes. FIG. 10 is a cross-sectional view of the abrasive part vertical to the longitudinal direction of the shaped structures. The respective sizes are shown in Table 4

TABLE 4

| Symbol | Size |
|---|---|
| h | 110 μm |
| s | 40 μm |
| p | 180 μm |

TABLE 2

| | Component | Example 1 | Example 2 | Example 3 | Comparative Example 1 |
|---|---|---|---|---|---|
| Epoxy resin | Cresol novolac epoxy resin solid ("YDCN-703", made by Tohto Kasei Co., Ltd.) | 40 | — | 20 | — |
| | Bisphenol a epoxy resin liquid ("YD-128", made by Tohto Kasei Co., Ltd.) | — | 50 | 25 | — |
| Acrylic compound | Trimethylolpropane triacrylate | 24 | 20 | 22 | 40 |
| | Isobornyl acrylate | 36 | 30 | 33 | 60 |
| Total (%) | | 100 | 100 | 100 | 100 |

TABLE 3

| | Component | Example 1 | Example 2 | Example 3 | Comparative Example 1 |
|---|---|---|---|---|---|
| Photo initiator | "Irgacure 907" made by Ciba Specialty Chemicals Inc. | 2 | 2 | 2 | 2 |
| Curing catalyst | 2-ethyl-4-methylimidazole | 5 | 5 | 5 | — |
| Acrylic compound | Isobornyl acrylate | 5 | 5 | 5 | — |
| Viscosity (cps) | | 1625 | 250 | 460 | |
| Epoxy resin content (%)* | | 38.1 | 47.6 | 42.9 | 0.0 |

*Epoxy resin weight %/(epoxy resin weight % + acrylic compound weight %)

Measurement of Adhesion Strength

With respect to each of produced abrasive films, the abrasive part and the substrate film were separated at 90° and the force required at that time was measured. In the abrasive films of Examples 1 to 3, substrate breakage occurred and potent adhesive property between the abrasive part and the substrate film was shown.

Cohesive failure occurs when the binding agent is poor in cohesive force, and interfacial failure occurs when poor in adhesive force.

The binder agent of Comparative Example 1 was low in adhesive force to the substrate film, and at the time of separating the casting sheet from the laminate product to which ultraviolet radiation had been carried out, the abrasive part was separated from the substrate film and the abrasive part remained in the casting sheet.

The measurement results of 90° separation strength are shown in Table 5.

TABLE 5

| | Example 1 | Example 2 | Example 3 |
|---|---|---|---|
| 90° separation strength (N/25 mm) | 40.8 | 47.3 | 44.3 |
| Fracture mode | SF | SF | SF |

SF: substrate fracture

Examples 4 and 5

Production of Abrasive Material Products

Each abrasive material coating solution was prepared by mixing the components shown in Table 1. Further, components shown in Table 6 were mixed to prepare each pre-mixture.

In Example 4, a photo initiator, "Irgacure 907", shown in Table 7 and a curing catalyst for an epoxy resin, 2-ethyl-4-methylimidazole, were dissolved in isobornyl acrylate to prepare a curing catalyst/initiator solution and next, the curing catalyst/initiator solution and the pre-mixture were mixed to prepare a binder coating solution.

In Example 5, a photo initiator, "Irgacure 907", and a curing catalyst for an epoxy resin, 2-ethyl-4-methylimidazole, were directly added to the pre-mixture to prepare a binder coating solution.

TABLE 6

| | Component | Example 4 | Example 5 |
|---|---|---|---|
| Epoxy resin | Cresol novolac epoxy resin solid ("YDCN-703", made by Tohto Kasei Co., Ltd.) | 20 | 15 |
| | Bisphenol A epoxy resin liquid ("YD-8125", made by Tohto Kasei Co., Ltd.) | — | 50 |
| Acrylic compound | Trimethylolpropane triacrylate | 32 | 14 |
| | Isobornyl acrylate | 48 | 21 |
| | Benzyl acrylate | — | — |
| Total (%) | | 100 | 100 |

TABLE 7

| | Component | Example 4 | Example 5 |
|---|---|---|---|
| Photo initiator | "Irgacure 907" made by Ciba Specialty Chemicals Inc. | 2 | 2 |
| Curing catalyst | 2-ethyl-4-methylimidazole | 5 | 5 |
| Acrylic compound | Isobornyl acrylate | 5 | — |
| Viscosity (cps) | | 1625 | 460 |
| Epoxy resin content (%)* | | 19.0 | 65.0 |

*Epoxy resin weight %/(epoxy resin weight % + acrylic compound weight %)

A casting sheet made of polypropylene same as that used in Example 1 was prepared. Next, each abrasive material coating solution was applied to the casting sheet by a knife coater and dried at 50° C. for 5 minutes.

Each of the binder coating solutions was applied to the sheet and HPE polyester film of 75 μm in thickness treated for easy adhesion, manufactured by Teijin-DuPont Films Japan Limited, was overlapped and laminated by pressure application by rolls. While the ultraviolet ray was radiated from the polyester film side to make the binder non-flowable, the laminate product was wound up in a roll form.

The rolled laminate product was put in an oven and heated at 90° C. for 20 hours to cure the resin of the abrasive material coating solution. After the laminate product was cooled to room temperature, the casting sheet was separated from the laminate product to obtain an abrasive film. The obtained abrasive film was further put in an oven and heated at 110° C. for 24 hours to cure the resin.

Measurement of Adhesion Strength

With respect to each of produced abrasive films, the abrasive part and the substrate film were separated at 90° and the force required at that time was measured. In the abrasive films of Examples 4 and 5, substrate breakage occurred and potent adhesive property between the abrasive part and the substrate film was shown.

The measurement results of 90° separation strength are shown in Table 8.

TABLE 8

| | Example 4 | Example 5 |
|---|---|---|
| 90° separation strength (N/25 mm) | 34.7 | 38.4 |
| Fracture mode | SF | SF |

SF: substrate fracture

Examples 6 and 7

Production of Abrasive Material Products

Components shown in Table 9 were mixed to prepare an abrasive coating solution.

TABLE 9

| Component | Weight (kg) | Solid content (%) |
|---|---|---|
| Diamond particles (average particle size of 1 to 2 μm) | 100.0 | 100 |
| Resol phenol resin (60% non-volatile content, 20% water, and residual organic solvent) | 58.3 | 60.0 |
| Propylene glycol monomethyl ether | 45.0 | 0 |
| Total | 203.3 | 66.4 |

A casting sheet made of polypropylene and having recessed parts with a shape reverse to a prism shape of the shaped structures as shown in FIG. 3 was prepared. Next, each abrasive material coating solution was applied to the casting sheet by a knife coater and dried at 50° C. for 5 minutes.

Pre-mixtures were prepared by dissolving the epoxy resin in the acrylic compound shown in Table 10.

TABLE 10

| | Component | Examples 6, 7 |
|---|---|---|
| Epoxy resin | Cresol novolac epoxy resin solid ("YDCN-703", made by Tohto Kasei Co., Ltd.) | 40 |
| Acrylic compound | Trimethylolpropane triacrylate | 24 |
| | Isobornyl acrylate | 36 |
| Total (%) | | 100 |

Components shown in Table 11 were mixed to prepare curing catalyst/initiator solutions. The pre-mixtures and the curing catalyst/initiator solutions were then mixed to prepare binder coating solutions.

TABLE 11

| | Component | Examples 6, 7 |
|---|---|---|
| Photo-initiator | "Irgacure 907" made by Ciba Specialty Chemicals Inc. | 2 |
| Curing catalyst | 2-ethyl-4-methylimidazole | 5 |
| Acrylic compound | Isobornyl acrylate | 5 |
| Viscosity (cps) | | 1625 |
| Epoxy resin content (%)* | | 38.1 |

*Epoxy resin weight %/(epoxy resin weight % + acrylic compound weight %)

Each of the binder coating solutions was applied to the casting sheet in which the abrasive material coating solution had been applied and dried. A polyester film of 125 μm in thickness was overlapped and laminated by applying pressure with a roll. While the ultraviolet ray was radiated from the polyester film side to make the binder non-flowable, the laminate product was wound up to a roll form.

The roll of the wound laminate product was put in an oven and heated at 90° C. for 24 hours to cure a resin of the abrasive material coating solution. After the laminate product was cooled to room temperature, the casting sheet was separated from the laminate product to obtain an abrasive film. The obtained abrasive film was further put in an oven and heated at 110° C. for 24 hours to cure the resin.

The abrasive film had an abrasive part having prism shaped structures arranged in stripes. FIG. 3 is a cross-sectional perspective view of the resulted abrasive material product. The respective sizes are shown in Table 12

TABLE 12

| Symbol | Size |
|---|---|
| h | 25 μm |
| s | 15 μm |
| p | 50 μm |
| w | 50 μm |
| u | 0 μm |

Abrading Test

A curved face of the cylindrical work (H45C) was abraded with applying high load with using each of the produced abrasive films, "SUPER FINISHER SP-100" manufactured by Matsuda Seiki K. K. as an abrasive apparatus, and "YUSHIROKEN" manufactured by Yoshiro Chemical Industry K. K. as a cutting fluid. Two levels of air pressure was used for changing the load at abrasion. The abrading conditions are shown in Table 13.

TABLE 13

| | |
|---|---|
| Air pressure | 10 kg and 40 kg |
| Film feeding speed | 110 mm/min |
| Hardness of buck up rubber roll | 90 degree |
| Oscillation | 600 cpm/2 mm |
| Infeed | 0.5 mm |
| Number of revolution | 96 rpm |
| Abrading time | 40 sec |

Thickness variation of the abrasive film between before and after the abrasion was determined, and the value was employed as an index for evaluating durability of the abrasive part. That is, the smaller the thickness variation, the more excellent the durability of the abrasive film. The test results are shown in Table 15.

Comparative Examples 2 and 3

Abrasive material products were prepared and tested according to the method substantially the same as described in examples 6 and 7, except that the binder coating solutions were prepared by mixing the components as shown in table 14. The test results are shown in Table 15.

TABLE 14

| | Component | Comparative Examples 2, 3 |
|---|---|---|
| Acrylic compound | Phenoxy diethylene glycol acrylate | 60 |
| | Epoxy acrylate | 40 |
| | Trimethylol propane triacrylate | 44 |
| Photo-initiator | "Irgacure 907" made by Ciba Specialty Chemicals Inc. | 2 |

TABLE 15

| | Example 6 | Example 7 | C. Ex. 2 | C. Ex. 3 |
|---|---|---|---|---|
| Resin component of lower layer of abrasive part | Epoxy-acryl mixture | Epoxy-acryl mixture | Acryl | Acryl |
| Kind of substrate film | Polyester film A[a)] | Polyester film B[b)] | Polyester film A | Polyester film B |

TABLE 15-continued

| | | Example 6 | Example 7 | C. Ex. 2 | C. Ex. 3 |
|---|---|---|---|---|---|
| Thickness variation (μm) | 10 kg air pressure | 21.7 | 17.8 | 20.3 | 41.5 |
| | 40 kg air pressure | 51.2 | 42.9 | 80.2 | 84.4 |

[a]An easy adhesion treated HPE polyester film manufactured by Teijin DuPont Films Japan Limited
[b]An EAA easy adhesion treated polyester film (ScotchPack) manufactured by 3M Company

The invention claimed is:

1. An abrasive material product comprising a substrate and an abrasive part having a plurality of shaped structures projecting from the substrate, wherein the abrasive part comprises (1) an upper layer composed of a cured material of a mixture containing abrasive particles dispersed in a phenol resin and (2) a lower layer composed of a cured material of a binder agent, the binder agent comprising a thermosetting epoxy resin and a photocurable acrylic compound wherein the photocurable acrylic compound comprises a monofunctional acrylic monomer and a polyfunctional acrylic monomer.

2. The abrasive material product according to claim 1, wherein the binder agent comprises 50 to 500 parts by weight of the photocurable acrylic compound based on 100 parts by weight of the thermosetting epoxy resin.

3. The abrasive material product according to claim 2, wherein the thermosetting epoxy resin comprises a cresol-novolac epoxy resin, a bisphenol A epoxy resin, or a mixture thereof.

4. The abrasive material product according to claim 2, wherein the photocurable acrylic compound comprises 20 to 100 parts by weight of the polyfunctional acrylate monomer based on 100 parts by weight of the monofunctional acrylate monomer.

5. The abrasive material product according to claim 2, wherein a plurality of the shaped structures are formed to have the same height from the surface of the substrate.

6. The abrasive material product according to claim 1, wherein the shaped structures have a shape having a narrower surface area of a cross section parallel to the substrate as the cross section is more apart from the substrate.

7. The abrasive material product according to claim 6, wherein the shaped structures form parallel rows of a prism shape or prism-like trapezoid and the rows of the shaped structures form an angle of 10 to 80° to the longitudinal direction of the substrate.

8. The abrasive material product according to claim 1, wherein the abrasive material product is used for abrasive work with applying high load.

9. A production method of an abrasive material product comprising an abrasive part having a plurality of shaped structures, wherein the production method comprises the steps of:

(1) filling a casting sheet having a plurality of recessed parts with an abrasive material coating solution containing abrasive particles, a phenol resin, and a solvent to a predetermined depth;

(2) removing the solvent from the abrasive material coating solution filled in the recessed parts by evaporation;

(3) further filling the recessed parts a binder agent coating solution, the binder agent coating solution comprising a thermosetting epoxy resin and a photocurable acrylic compound, wherein the photocurable acrylic compound comprises a monofunctional acrylic monomer and a polyfunctional acrylic monomer;

(4) layering a substrate to the casting sheet to bond the binder agent to the substrate;

(5) making the binder agent non-flowable by radiating radioactive ray; and (6) curing the thermosetting resin.

10. The production method of an abrasive material product according to claim 9, wherein the step (6) of curing the thermosetting epoxy resin is carried out by a process comprising the steps of:

rolling the abrasive material product containing the binder agent made non-flowable by radiating radioactive ray and the casting sheet to a roll form; and keeping the rolled abrasive material product and casting sheet in the roll form at 50 to 150° C. to cure the abrasive part.

11. The production method of an abrasive material product according to claim 9, wherein the abrasive material product is used for abrasive work with applying high load.

12. A method for abrading a curved face of a work piece comprising the steps of:

bringing the abrasive material product according to claim 1 into contact with a curved face of a work piece; and moving the work piece relatively to the abrasive material product to at least partially abrade the curved face.

13. An abrasive article, comprising:

a substrate;

shaped structures comprising abrasive material arrange don the substrate;

wherein the shaped structures comprise a base portion substantially free of abrasive particles arranged adjacent the substrate and a top portion containing abrasive particles arranged adjacent the base portion, wherein the base portion comprises cured material of a first binder material and the tip portion comprises cured material of a second binder material different from the first binder material; and wherein the first binder material of the base portion comprises a thermosetting epoxy resin and a photocurable acrylic compound, and the second binder material of the top portion comprises a phenol resin.

14. The abrasive article of claim 13, wherein the photocurable acrylic compound comprises a monofunctional acrylic monomer and a polyfunctional acrylic monomer.

* * * * *